United States Patent [19]

Keely

[11] 4,132,358

[45] Jan. 2, 1979

[54] SPRINKLER NOZZLE

[76] Inventor: Robert H. Keely, 27 10th Ave. W., Kalispell, Mont. 59901

[21] Appl. No.: 731,027

[22] Filed: Oct. 8, 1976

[51] Int. Cl.[2] ..... B05B 15/10

[52] U.S. Cl. ..... 239/204; 239/524

[58] Field of Search ..... 239/203, 204, 500, 518, 239/524

[56] References Cited

U.S. PATENT DOCUMENTS

| | | | |
|---|---|---|---|
| 1,863,914 | 6/1932 | Tyler | 239/524 X |
| 2,050,659 | 8/1936 | Knuth | 239/204 |
| 2,501,910 | 3/1950 | Oughton | 239/204 |
| 2,607,623 | 8/1952 | Lippert | 239/204 |
| 2,639,191 | 5/1953 | Hruby | 239/222.17 X |
| 3,589,616 | 6/1971 | Stephens | 239/204 |

*Primary Examiner*—Joseph F. Peters, Jr.

*Assistant Examiner*—Michael Mar

*Attorney, Agent, or Firm*—Boniard I. Brown

[57] ABSTRACT

A pop-up nozzle for an underground sprinkler system. The nozzle includes a spray head fastened to the top of a hollow stem which is slidably mounted within a cylindrical sleeve. The sleeve is imbedded in the ground, and its lower end is connected to a source of pressurized water. As water flows into the sleeve, the stem and spray move axially within the sleeve so that the spray head projects above ground level and allows water emanating from the spray head to clear ground obstructions. A radial projection on the stem mates with one of a plurality of circumferentially spaced axial grooves in the sleeve to fix the angular position of the spray in a predetermined direction when a unidirectional spray head is used.

10 Claims, 5 Drawing Figures

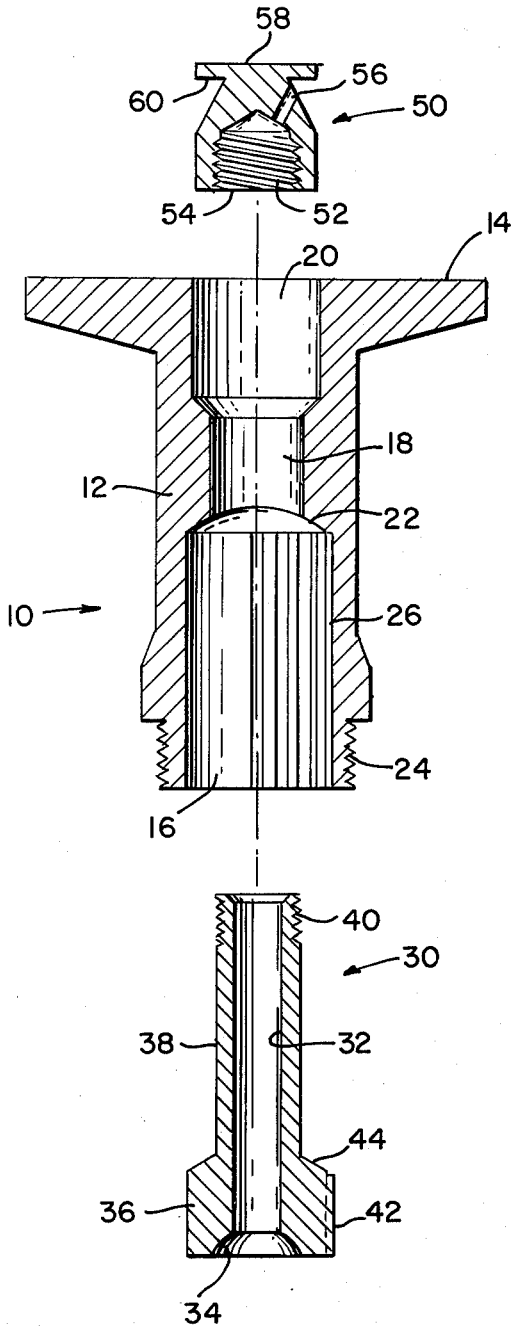
FIG. 1
FIG. 2
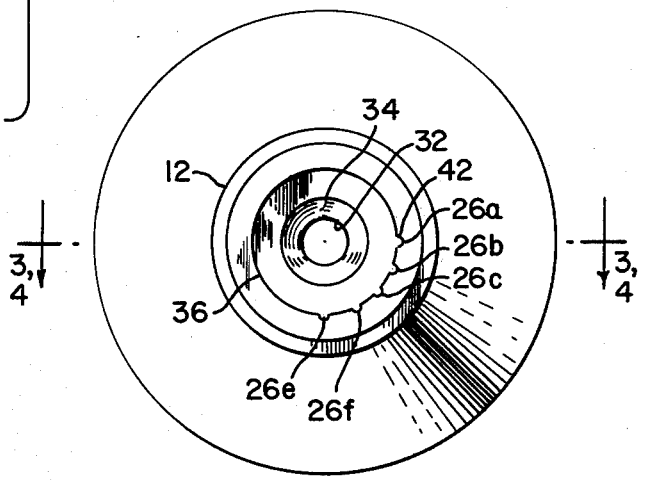

SPRINKLER NOZZLE

BACKGROUND OF THE INVENTION

1. Field of the Invention

This invention relates to underground sprinkler systems, and more particularly, to a pop-up nozzle for an underground sprinkler system.

2. Description of the Prior Art

Underground sprinkler systems have long been utilized to provide irrigation water to lawns, gardens and shrubbery. The primary advantage of such sprinkler systems is their lack of visibility when the system is not operating since the pipes interconnecting the sprinkler nozzles are concealed underground and the sprinkler nozzles themselves are generally positioned flush with the surface of the ground. The conventional nozzles utilized with the sprinkler systems generally rise above the surface of the ground when the sprinkler is operating but return to their flush position when water flow is terminated. Conventional sprinkler nozzles for these underwater sprinkler systems generally exhibit a number of problems. They are usually fabricated from a large number of parts which must be assembled thereby making these nozzles somewhat expensive since the manufacturing and assembling costs are quite high. Another serious disadvantage of such nozzles is that the water must be at a relatively high pressure in order to raise the sprinkler nozzle above the surface of the ground. Consequently, the use of such sprinkler nozzles is somewhat limited.

SUMMARY OF THE INVENTION

It is an object of the invention to provide a sprinkler nozzle having a relatively small number of easily fabricated and assembled parts.

It is another object of the invention to provide a pop-up sprinkler nozzle which is capable of operating at relatively low water pressures.

It is still another object of the invention to provide a pop-up sprinkler nozzle which allows the water distribution pattern to be varied without removing the nozzle from the ground.

These and other objects of the invention are accomplished by a sprinkler nozzle which includes an elongated stem slidably mounted within a cylindrical sleeve. A sprinkler head is fastened to the top end of the stem. The sprinkler head contains a plurality of conduits which direct water from axial bore in the stem against a horizontal deflector plate so that the water is deflected outwardly in a radial direction. Valve seats integrally formed in the stem and sleeve prevent water from flowing between the stem and sleeve so that virtually all of the water flowing into the sleeve flows through the stem and conduits and is deflected outwardly. The stem includes a radial projection which mates with one of a plurality of axial grooves on the inner wall of the sleeve which prevents the stem from rotating so that water is directed in a predetermined direction when a unidirectional spray head is utilized. The lower end of the stem is beveled inwardly to provide greater lift so that a relatively low pressure head of water is capable of lifting the stem above the surface of the ground.

BRIEF DESCRIPTION OF THE FIGURES OF THE DRAWINGS

FIG. 1 is an exploded cross-sectional view taken along the line 1—1 of FIG. 2 showing the sprinkler nozzle body, the hollow stem mounted within the sprinkler nozzle body, and the sprinkler head which is fastened to the top of the stem.

FIG. 2 is a bottom plan view of the assembled sprinkler nozzle.

DETAILED DESCRIPTION OF THE INVENTION

Figure 3:
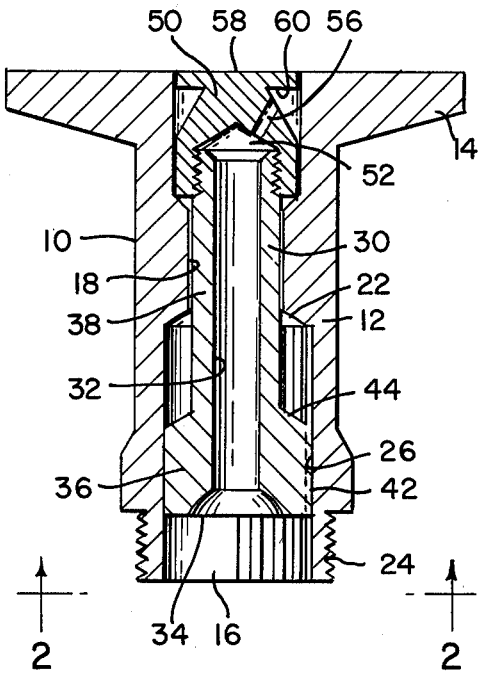
FIG. 3 is a cross-sectional view of the sprinkler nozzle taken along the line 3—3 of FIG. 2 showing the sprinkler nozzle in non-operating position.

The nozzle body as illustrated in FIG. 1 includes a cylindrical sleeve 12 having an annular flange 14 integrally formed at its top end. The sleeve 12 has an axial bore including a widened bottom portion 16, a narrowed center portion 18 and a widened top portion 20. An inclined transition between the bottom portion 16 and center porton 18 forms a valve seat 22 as described hereinafter. External threads 24 are formed at the lower end of the sleeve 12 for connecting the sprinkler nozzle to a conventional water conduit.

The stem 30 which is received within the bore of the sleeve 12 contains an axial bore 32 extending along its full length for supplying water to the sprinkler head as described hereinafter. The lower portion of the bore 32 flares outwardly at 34 to form a concave, lower end which, as explained hereinafter, allows the stem 30 to pop up when the nozzle is supplied with water having a relatively low pressure. The stem 30 includes an enlarged lower portion 36 and a narrowed upper portion 38 terminating in an external thread 40. The enlarged lower portion 36 includes a radial spline 42 which fits the groove 26 (FIG. 1) in the bottom portion of the bore 16 in the sleeve 12 to prevent the stem 30 from rotating within the stem 12 while allowing the stem 30 to move axially with respect to the stem 12. The transition between the lower portion 36 and the upper portion 38 includes an inclined surface which forms a seat 44 mating with the seat 22 (FIG. 1) of the sleeve 12 when the stem 30 is in a raised position as illustrated in greater detail hereinafter.

The spray head 50 as illustrated in FIG. 3 includes a cavity 52 having internal threads 54 which engage the threads 40 at the top of the stem 30. A plurality of circumferentially spaced bores 56 extend between the cavity 52 and the outer surface of the head 50. A horizontal deflector plate 58 extends above the openings of the bores 56 so that water flowing through the bores 56 strikes the lower, horizontal surface 60 of the deflector plate 58 and is directed radially outward.

Figure 4:
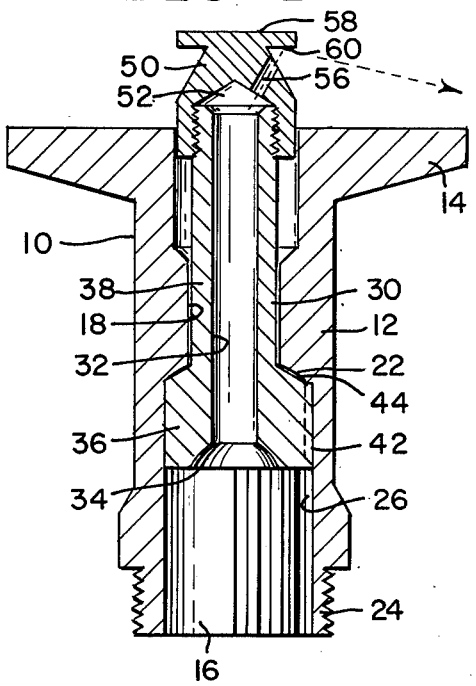
FIG. 4 is a cross-sectional view taken along the line 4—4 of FIG. 2 showing the sprinkler nozzle in operating position.

As indicated by the bottom view of the assembled sprinkler nozzle of FIG. 4, the spline 42 of the stem 30 is received by one of a plurality of circumferentially spaced axial grooves 26*a–e* formed in the inside walls of the lower portion of the bore 16. Thus the angular position of the stem 30 with respect to the body 10 can be adjustably fixed by inserting the spline 42 in a preselected groove 26 when assembling the sprinkler nozzle. This feature allows the sprinkler head 50 to direct water in a predetermined direction when a sprinkler head 50 having a directional distribution characteristic is utilized.

Figure 5:
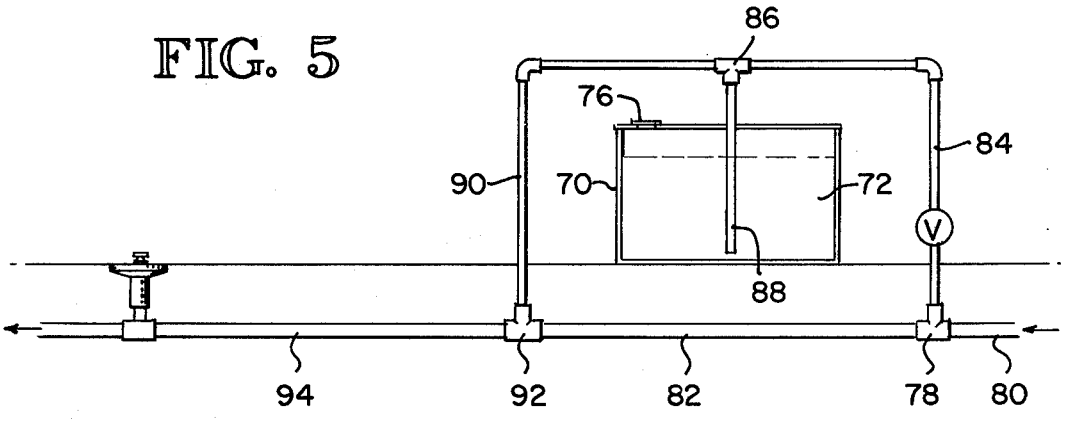
FIG. 5 is a schematic of a fertilizing system for use with a sprinkler system.

The sprinkler nozzle is shown in its assembled, non-operating condition in FIG. 5. When water is not flowing into the nozzle, the stem 30 and spray head 50 are recessed within the body 10 with the top surface of the deflector plate 58 flush with the top surface of the annular flange 14. The upper, narrowed portion of the stem 38 is loosly received in the central portion 18 of the bore in the sleeve 12 so that any dirt and debris which enters the nozzle is easily cleared from the space between the stem 30 and body 10. When water pressure is applied to the nozzle, the stem 30 and spray nozzle 50 are forced upwardly as illustrated in FIG. 6. The concave, lower end 34 of the stem 30 increases the lifting characteristics of the stem 30 so that a relatively slight amount of water pressure is sufficient to raise the spray head 50 above the top surface of the annular flange 14. The concave lower end of the stem 30 allows the stem 30 to pop up at a relatively low water pressure by providing a relatively high pressure at the lower end of the stem 30 as explained hereinafter. The upward force exerted on the stem 30 is proportional to the pressure differential on opposite ends of the stem 30. It is a well known principle of fluid mechanics that the pressure of a fluid in a fluid stream decreases as the velocity of the stream increases. By providing a flared or concave entrance to the bore 32 the flow of water into the bore is relatively smooth when compared to a flat or non-tapered transition. Consequently, with applicant's structure the stream of water flows through a relatively large cross-sectional area causing a relatively low velocity flow and a relatively high pressure. An abrupt transition between the bores 32,16 causes the flow of water at the entrance to the bore 32 to be relatively turbulent. Under turbulent flow conditions the stream of water occupies a smaller cross-sectional area at the mouth of the bore 32 resulting in relatively high velocity water flow and, consequently, a relatively low pressure. As mentioned above, it is the relatively high pressure at the lower end of the stem 30 which allows the stem 30 to pop up with relatively low water pressures.

Water flows through the bore 32 in the stem 30 into the cavity 52 in the spray head 50. Water then flows from the cavity 52 through the bores 56 and strikes the horizontal surface of the deflector plate 58 which directs the water radially outward onto the surface to be irrigated. Sufficient clearance is provided between the stem 30 and bore 18 so that the stem 30 vibrates when water is flowing through the bore 32 thereby cleaning particles and debris from the space between the stem 30 and body 10. In the raised position illustrated in FIG. 6, the inclined seating surface 44 of the stem 30 forcibly contacts the inclined seating surface 22 of the body 10 to prevent water from bypassing the bore 32 in the stem 30 by flowing between the stem 30 and the body 10. By forming the seating surfaces integrally with the stem 30 and body 10, the requirement for a separate valve seat is eliminated thereby reducing the cost of the spray nozzle and simplifying its construction when compared with conventional pop-up sprinkler nozzles. When the spray head 50 is in its raised position as illustrated in FIG. 6, the spray head 50 can be changed simply by unscrewing the head 50 from the stem 30 and installing a new head 50. The spline 42 mating with the groove 26 prevents the stem 30 from rotating during this operation.

The sprinkler nozzle can be fabricated from a wide variety of materials. By utilizing a fairly light material for the stem 30 and spray head 50 the nozzle will function properly with lower water pressures since the lower weight of the stem 30 and pressure head 50 requires less lifting force.

A fertilizing system for use with the underground sprinkler system of the present invention is illustrated in FIG. 7. The system includes a tank 70 containing a quantity of a liquid fertilizer 72 placed in the tank 70 through a top opening 74 covered by a cap 76. A valve 78 allows water from a water supply line 80 to bypass the fertilizer tank 70 through bypass conduit 82 while selectively supplying water to a fertilizer supply conduit 84. The supply conduit 84 flows through a T section 86 having its center leg communicating with the fertilizer 72 through a fertilizer inlet 88. The water and fertilizer then flow from the T 86 through a fertilizer outlet 90 where it is combined with the water from the bypass conduit 82 in a T section 92 and is delivered to the sprinkler nozzles through conduit 94. As water flows through the T 86, a pressure reduction occurs in line 88 thereby drawing fertilizer 72 from the tank 70 and mixing it with the water delivered through conduit 84. The diluted fertilizer flowing from conduit 90 then mixes with the pure water from the bypass conduit 82 before being delivered to the sprinkler nozzles. The concentration of the fertilizer may be regulated by adjusting the valve 78.

The embodiments of the invention in which a particular property or privilege is claimed are defined as follows:

1. A pop-up sprinkler nozzle for an underground sprinkler system, comprising:

an elongated stem having an axial bore, said stem having an enlarged portion at its lower end forming an inclined seat;

a sprinkler body including a hollow, cylindrical sleeve forming a stem receiving cavity, said cavity having an enlarged portion at its lower end receiving the enlarged lower portion of said stem and forming an inclined seat adapted to mate with the seat of said stem when said stem is in a raised position; and a spray head fastened to the top of said stem, said head having a downwardly facing horizontal deflection plate surface, and means defining a plurality of conduits communicating with said bore and respectively disposed at an angle relative to the axis of the bore to direct water to impinge upon the downwardly facing deflection plate surface to deflect the water outwardly.

2. The nozzle of claim 1, wherein at least one spline extends outwardly from the periphery of said stem and is received by one of a plurality of circumferentially spaced axial grooves extending along the inside walls of said stem receiving cavity, thereby fixing the angular position of said stem with respect to said body in a predetermined position while allowing said stem to move axially with respect to said body.

3. The nozzle of claim 1, wherein the lower end of said stem forms a concave surface to which the bore of said stem opens to increase the lifting characteristics of said stem responsive to water pressure on the lower end of said stem.

4. The nozzle of claim 1, wherein sufficient clearance is provided between said stem and body such that said stem vibrates as water flows through the bore in said stem, thereby cleaning particles and debris from the space between said stem and body.

5. A pop-up sprinkler nozzle according to claim 1, wherein:

said conduits are defined in the spray head and are angularly disposed relative to the bore axis with their upper portions extending outwardly and upwardly to direct the water against the deflection plate surface.

6. A pop-up sprinkler nozzle for an underground sprinkler system, comprising:

an elongated stem having an axial bore, a spray head having a downwardly facing horizontal deflection plate surface, a sprinkler body including a hollow, cylindrical sleeve forming a stem receiving cavity, sufficient clearance being provided between said stem and body that said stem vibrates as water flows through the bore in said stem thereby cleaning particles and debris from the space between said stem and body, means defining a plurality of conduits communicating with said bore and respectively disposed at an angle relative to the axis of the bore to direct water to impinge upon the downwardly facing deflection plate to deflect the water outwardly.

7. A pop-up sprinkler nozzle according to claim 6, wherein:

said conduits are defined in the spray head and are angularly disposed relative to the bore axis with their upper portions extending outwardly and upwardly to direct the water against the deflection plate surface.

8. A pop-up sprinkler nozzle according to claim 6, wherein:

said cavity has an enlarged portion at its lower end receiving the enlarged lower portion of said stem and forming an inclined seat adapted to mate with the seat of said stem when said stem is in a raised position.

9. A pop-up sprinkler nozzle according to claim 6, wherein:

a spline extends outwardly from the periphery of said stem and is received by one of a plurality of circumferentially spaced axial grooves extending along the inside walls of said stem receiving cavity, thereby fixing the angular position of said stem with respect to said body in a predetermined position while allowing said stem to move axially with respect to said body.

10. A pop-up sprinkler nozzle according to claim 6, wherein:

the lower end of said stem forms a concave surface to which the bore of said stem opens to increase the lifting characteristics of said stem responsive to water pressure on the lower end of said stem.

* * * * *